US011739401B2

(12) United States Patent
Goto et al.

(10) Patent No.: US 11,739,401 B2
(45) Date of Patent: Aug. 29, 2023

(54) BLACK HEART MALLEABLE CAST-IRON AND METHOD FOR MANUFACTURING SAME

(71) Applicant: Proterial, Ltd., Tokyo (JP)

(72) Inventors: Ryo Goto, Tokyo (JP); Takayuki Fukaya, Tokyo (JP); Hiroshi Matsui, Tokyo (JP); Kenta Matsuura, Tokyo (JP)

(73) Assignee: Proterial, Ltd., Tokyo (JP)

( * ) Notice: Subject to any disclaimer, the term of this patent is extended or adjusted under 35 U.S.C. 154(b) by 568 days.

(21) Appl. No.: 16/496,894

(22) PCT Filed: Mar. 12, 2018

(86) PCT No.: PCT/JP2018/009527

§ 371 (c)(1),
(2) Date: Sep. 23, 2019

(87) PCT Pub. No.: WO2018/180424

PCT Pub. Date: Oct. 4, 2018

(65) Prior Publication Data

US 2020/0080173 A1 Mar. 12, 2020

(30) Foreign Application Priority Data

Mar. 27, 2017 (JP) ..... 2017-061680

(51) Int. Cl.

| | |
|---|---|
| ***C22C 37/10*** | (2006.01) |
| ***C21D 5/14*** | (2006.01) |
| ***C22C 33/08*** | (2006.01) |

(52) U.S. Cl.

CPC ..... *C22C 37/10* (2013.01); *C21D 5/14* (2013.01); *C22C 33/08* (2013.01); *C21D 2211/005* (2013.01)

(58) Field of Classification Search

USPC ..... 420/13

See application file for complete search history.

(56) References Cited

U.S. PATENT DOCUMENTS

| | | | |
|---|---|---|---|
| 2,227,217 A | 12/1940 | Crafts | |
| 2,260,998 A | 10/1941 | Lorig | |
| 3,565,698 A | 2/1971 | de Mercoyrol de Beaulieu | |

FOREIGN PATENT DOCUMENTS

| | | | | |
|---|---|---|---|---|
| CN | 85106684 A | | 3/1987 | |
| GB | 2147007 A | * | 5/1985 | ..... C22C 37/04 |

(Continued)

OTHER PUBLICATIONS

English language machine translation of SU 1744141 A1 to Samojlenko et al. Generated Jun. 3, 2022. (Year: 2022).*

(Continued)

*Primary Examiner* — Brian D Walck

(74) *Attorney, Agent, or Firm* — Morgan, Lewis & Bockius LLP

(57) ABSTRACT

Provided is a black heart malleable cast iron and a method for manufacturing the same which can significantly shorten the time required for graphitization, as compared with the prior art. The black heart malleable cast iron includes a matrix of ferrite and lump graphite included in the matrix, and includes at least one selected from the group consisting of (i) 0.0050% by mass or more and 0.15% by mass or less of bismuth and 0.020% by mass or more of manganese, and (ii) 0.0050% by mass or more and 1.0% by mass or less of aluminum and 0.0050% by mass or more of nitrogen. In addition, the grain size of the matrix is 8.0 or more and 10.0 or less in terms of grain size number, numerically determined by comparison between a metallographic photograph of the matrix and a standard grain size chart.

11 Claims, 2 Drawing Sheets

(56) References Cited

FOREIGN PATENT DOCUMENTS

| | | | | | |
|---|---|---|---|---|---|
| JP | 46-17421 | | | 5/1971 | |
| JP | H02-290944 | A | | 11/1990 | |
| KR | 20140061165 | A | * | 5/2014 | |
| SU | 1723180 | A1 | * | 3/1992 | |
| SU | 1744141 | A1 | * | 6/1992 | |
| WO | WO-2006072663 | A2 | * | 7/2006 | ..... C22C 33/08 |

OTHER PUBLICATIONS

English language machine translation of SU 1723180 A1 to Ivanenko et al. Generated Jun. 3, 2022. (Year: 2022).*
BCIRA Broadsheet 41. "Nitrogen in cast iron." British Cast Iron Research Association. 1971. (Year: 1971).*
English language machine translation of KR-20140061165-A. Generated Apr. 5, 2023. (Year: 2023).*
International Search Report issued in corresponding International Patent Application No. PCT/JP2018/009527 dated Jun. 12, 2018.
International Preliminary Report on Patentability and Written Opinion issued in corresponding International Patent Application No. PCT/JP2018/009527 dated Oct. 10, 2019.
"Microscopic Test Method of Steel-Grain Size," Japan Industrial Standards JIS G 0551, Japan Standards Institute, revised Jan. 21, 2013 with concise explanation.
International Search Report issued in related International Patent Application No. PCT/JP2021/008746 dated Apr. 27, 2021.
Extended European Search Report issued in corresponding European Patent Application No. 18777936.8 dated Nov. 16, 2020.
Office Action issued in corresponding Japanese Patent Application No. 2019-509184 dated Apr. 5, 2022.
Office Action issued in corresponding Chinese Patent Application No. 201880013088.7 dated Feb. 1, 2021.
Yang Zhihai et al., "Study on Properties and Metallograph of Black Malleable Irons," Journal of Jiamusi University (Natural Science Edition), 27 (3): 398-401 (2009) (see English translation of Chinese Office Action).
Office Action issued in corresponding Chinese Patent Application No. 201880013088.7 dated Jun. 28, 2021.
Qingchun et al., "Shortening the Annealing Time of Black Heart Malleable Cast Iron by Adding Boron and Bismuth," Journal of Haerbin Industrial University, 2: 77-84 (1959) (see CN OA).
Peiwen, "Effect of Micro-alloying Elements on the Graphitization of Black Heart Malleable Cast Iron," Journal of Taiyuan Institute of Engineering, 27-44 (1964) (see CN OA).
International Preliminary Report on Patentability and Written Opinion issued in related International Patent Application No. PCT/JP2021/008746 dated Sep. 15, 2022.
Office Action issued in corresponding Chinese Patent Application No. 202180007637.1 dated Apr. 19, 2023.

* cited by examiner

BLACK HEART MALLEABLE CAST-IRON AND METHOD FOR MANUFACTURING SAME

TECHNICAL FIELD

The present invention relates to black heart malleable cast irons and a method for manufacturing the same.

BACKGROUND ART

Cast irons can be classified into flake graphite cast iron, spheroidal graphite cast iron, malleable cast iron, and the like according to the existence form of carbon. The malleable cast irons can be further classified into white heart malleable cast iron, black heart malleable cast iron, pearlite malleable cast iron, and the like.

Black heart malleable cast iron, which is a subject matter of the present invention, is also simply called malleable cast iron and has the form in which graphite is present while being dispersed in a matrix made of ferrite. Black heart malleable cast iron is superior in mechanical strength compared to flake graphite cast iron and also excellent in toughness because of its ferrite matrix. For this reason, black heart malleable cast iron is widely used as material for producing automobile parts, pipe joints, and the like, which require mechanical strength.

For flake graphite cast iron and spheroidal graphite cast iron, flake or spheroidal graphite is precipitated in a cooling process after casting. In contrast, for black heart malleable cast iron, carbon in a cast metal obtained after the casting and cooling processes is present in cementite form ($Fe_3C$), which is a compound of carbon with iron. Thereafter, the cast metal is heated to and held at a temperature of 720° C. or higher, so that the cementite is decomposed to precipitate graphite. Herein, the step of precipitating graphite by heat treatment is hereinafter referred to as "graphitization".

Graphitization of black heart malleable cast iron takes a very long time. The graphitization includes first stage graphitization where cementite liberated in austenite is decomposed at a temperature of 900° C. or higher, and second stage graphitization where cementite in pearlite is decomposed at a temperature of around 720° C. after the first stage graphitization. Both the first stage graphitization and the second stage graphitization generally take several hours to several tens of hours because those stages of graphitization proceed accompanied by the diffusion of carbon in the matrix and the precipitation of graphite. This prolonged graphitization leads to an increase in the manufacturing cost of black heart malleable cast iron.

To shorten the time required for the graphitization, various methods have been conventionally studied. The first method is a method that involves adjusting the components of the black heart malleable cast iron or adding a new additive element, thereby shortening the time required for the graphitization. For example, Patent Document 1 mentions a method for manufacturing a black heart malleable cast iron that involves adjusting the content of silicon, which is an element promoting graphitization, to be higher than its normal amount, and then adding misch metal to a molten metal before the casting. This manufacturing method can shorten the time required for the first stage graphitization to 2 hours and the time required for the second state graphitization to 4 hours, while preventing the formation of flake graphite in the cooling process immediately after the casting by the addition of the misch metal.

The second method is a method that involves performing heat treatment at a temperature lower than a temperature required for graphitization, before the graphitization is conducted. For example, Patent Document 2 mentions that the time required for graphitization can be shortened as compared with the prior art by applying heat treatment to a cast iron for at least 10 hours at a low temperature within the range of 100° C. to 400° C. Patent Document 3 mentions that by employing the second method, the time required for the first stage graphitization and the second stage graphitization can be shortened, and after the graphitization, the grain size of graphite becomes smaller as compared with the prior art, while the number of graphite particles increases.

PRIOR ART DOCUMENT

Patent Document

Patent Document 1: JP 46-17421 B
Patent Document 2: U.S. Pat. No. 2,227,217
Patent Document 3: U.S. Pat. No. 2,260,998

Non-Patent Document

Non-Patent Document 1: "Microscopic Test Method of Steel-Grain Size", Japan Industrial Standards JIS G 0551, Japan Standards Institute, revised Jan. 21, 2013

DISCLOSURE OF THE INVENTION

Problems to be Solved by the Invention

In the first method mentioned above, the content of silicon that promotes graphitization is increased. Thus, depending on the shape of a mold, the cooling rate immediately after casting, and other cooling conditions, flaky graphite called "mottle" is more likely to be formed at the time of casting and during the cooling process thereafter. The mottle formed at the time of the casting does not disappear by the subsequent heat treatment, which leads to a decreased mechanical strength of the black heart malleable cast iron. For this reason, the first method has a problem that there is a risk of decreasing mechanical strength of the cast iron when carried out on an industrial scale.

In the second method mentioned above, the time required to perform the heat treatment at a temperature lower than the temperature required for graphitization is long, for example, approximately 8 hours to 10 hours. Consequently, the total heat treatment time required for the newly performed heat treatment and the conventional graphitization is not necessarily shortened. Therefore, since the manufacturing cost required for the heat treatment cannot be significantly reduced, the second method has not been widely used either.

The present invention has been made in view of the above-mentioned problems, and it is an object of the present invention to provide a black heart malleable cast iron and a method for manufacturing the same which can significantly shorten the total heat treatment time required for graphitization of the black heart malleable cast iron and which can be stably employed without any risk of the formation of a mottle during a casting process.

Means for Solving the Problems

The present invention in a first embodiment provides a black heart malleable cast iron including a matrix of ferrite and a lump graphite included in the matrix, the black heart malleable cast iron including at least one selected from the group consisting of:

(i) 0.0050% by mass or more and 0.15% by mass or less of bismuth and 0.020% by mass or more of manganese; and (ii) 0.0050% by mass or more and 1.0% by mass or less of aluminum and 0.0050% by mass or more of nitrogen, wherein a grain size of the matrix is 8.0 or more and 10.0 or less in terms of grain size number, numerically determined by comparison between a metallographic photograph thereof and a standard grain size chart. As mentioned above, when the black heart malleable cast iron contains a predetermined amount of a combination of bismuth and manganese or a combination of aluminum and nitrogen, the lump graphite is more likely to be easily dispersed at positions of crystal grain boundaries of the matrix, which makes it to easily form the metallographic structure in which the grain size of the matrix is 8.0 or more and 10.0 or less in terms of grain size number.

In a preferred embodiment, in the black heart malleable cast iron according to the present invention, the lump graphite is present while being dispersed at positions of crystal grain boundaries of the matrix. When the lump graphite is present while being dispersed at the positions of the crystal grain boundaries of the matrix, the movement of the crystal grain boundaries and the growth of crystal grains of the matrix are inhibited, thus making it possible to refine the grain size of the matrix, compared to a conventional black heart malleable cast iron. The migration distance of carbon atoms due to their diffusion in the graphitization step is the length at most from the center of the crystal grain of the matrix to the position of the corresponding crystal grain boundary thereof. As a result, the heat treatment time required for the graphitization can be shortened to, for example, 3 hours or less.

In a preferred embodiment, in the black heart malleable cast iron according to the present invention, an average particle diameter of particles of the lump graphite is 10 micrometers or more and 40 micrometers or less. In another preferred embodiment, in the black heart malleable cast iron according to the present invention, the number of particles of the lump graphite per square millimeter of the cross-sectional area thereof is 200 or more and 1,200 or less.

In a preferred embodiment, the black heart malleable cast iron according to the present invention includes 2.0% by mass or more and 3.4% by mass or less of carbon, and 0.5% by mass or more and 2.0% by mass or less of silicon, the balance being iron and inevitable impurities. In a more preferred embodiment, in the black heart malleable cast iron, the carbon content is 2.5% by mass or more and 3.2% by mass or less, the silicon content is 1.0% by mass or more and 1.7% by mass or less.

In a preferred embodiment, the black heart malleable cast iron according to the present invention further includes more than 0% by mass and 0.010% by mass or less of boron.

In a second embodiment, the present invention provides a method for manufacturing a black heart malleable cast iron, which includes the steps of:

casting a casting material to produce a cast metal including 2.0% by mass or more and 3.4% by mass or less of carbon, 0.5% by mass or more and 2.0% by mass or less of silicon, and at least one selected from the group consisting of:

(i) 0.0050% by mass or more and 0.15% by mass or less of bismuth, and 0.020% by mass or more of manganese, and (ii) 0.0050% by mass or more and 1.0% by mass or less of aluminum and 0.0050% by mass or more of nitrogen, the balance being iron and inevitable impurities;

preheating the cast metal at a temperature of 275° C. or higher and 425° C. or lower; and graphitizing the cast metal at a temperature exceeding 680° C. after the preheating.

In a preferred embodiment, in the method for manufacturing a black heart malleable cast iron according to the present invention, the cast metal further contains more than 0% by mass and 0.010% by mass or less of boron.

In a preferred embodiment, in the method for manufacturing a black heart malleable cast iron according to the present invention, a time for preheating the cast metal at the temperature of 275° C. or higher and 425° C. or lower in the preheating step is 30 minutes or more and 5 hours or less.

In a preferred embodiment, in the method for manufacturing a black heart malleable cast iron according to the present invention, a total time for graphitizing the cast metal at the temperature exceeding 680° C. in the graphitizing step is one hour or more and 6 hours or less.

In a preferred embodiment, in the method for manufacturing a black heart malleable cast iron according to the present invention, the graphitization step includes a first stage graphitization that includes heating the cast metal at a temperature exceeding 900° C., and a second stage graphitization in which a start temperature is 720° C. or higher and 800° C. or lower, and a completion temperature is 680° C. or higher and 720° C. or lower.

Effects of the Invention

According to the black heart malleable cast iron and the method for manufacturing the same in the present invention, the migration distance of the graphite due to diffusion of carbon atoms in the graphitization step can be shortened without forming any mottle in the casting step. As a result, the total heat treatment time including the preheating and the graphitizing steps can be significantly shortened, thus greatly reducing a manufacturing cost of the cast iron required for the heat treatment. In addition, the refined crystal grains of the resultant matrix leads to improvement of the mechanical strength of the black heart malleable cast iron.

BEST MODE FOR CARRYING OUT THE INVENTION

Figure 1:
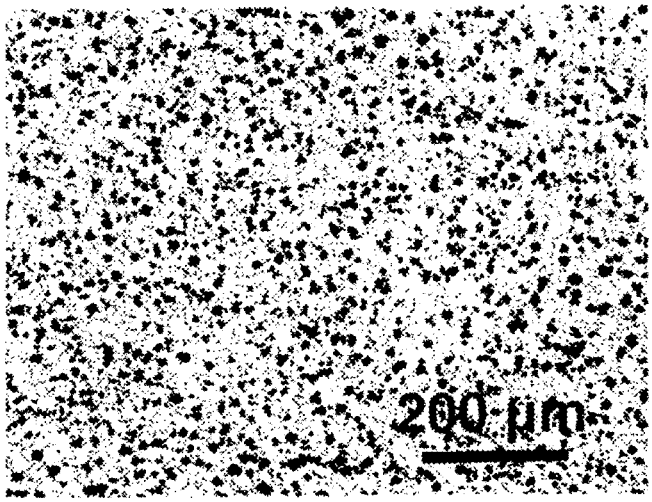
FIG. 1 is a metallographic photograph of a cast metal in Examples of the present invention.

Embodiments for carrying out the present invention will be described in detail below with reference to the accompanying drawings and tables. It should be noted that the embodiments mentioned herein are merely examples, and the embodiments for carrying out the present invention are not limited to the embodiments mentioned herein.

[Metallographic Structure]

The metallographic structure of a black heart malleable cast iron according to the present invention will be described.

In a first embodiment of the present invention, the black heart malleable cast iron has a matrix of ferrite. In the present specification, the term "ferrite" refers to the a phase in the iron-carbon equilibrium diagram. In addition, as used in the present specification, the term "matrix" is a residual microstructure excluding graphite, and refers to a main phase or parent phase which occupies most of the volume (area in cross-sectional observation) of an alloy, among phases included in the alloy. Specifically, for example, when observing a micrograph, such as that shown in FIG. 1 mentioned later, in a case where the area ratio of ferrite to the whole microstructure of the black heart malleable cast iron is 80% or more, the ferrite is a main phase or parent phase that occupies most of the alloy. In the present invention, this ferrite corresponds to the matrix. After the graphitization is completed, the matrix is composed of ferrite which hardly contains solid-solution carbon. Therefore, the black heart malleable cast iron according to the present invention has excellent toughness, similarly to the conventional black heart malleable cast iron.

The black heart malleable cast iron according to the present invention has lump graphite contained in a matrix. In the present specification, the term "lump graphite" refers to a precipitated phase that is made of graphite and has the form in which a plurality of graphite particles are agglomerated to form a lump aggregate. The lump graphite is contained while being surrounded by the ferrite matrix.

In the black heart malleable cast iron according to the present invention, the grain size of the matrix is 8.0 or more and 10.0 or less in terms of grain size number, which is numerically determined by comparison between a metallographic photograph of the matrix and a standard grain size chart. In the present specification, the term "standard grain size chart" refers to a set of diagrammatic representations of grain boundaries in metallographic structures having various grain sizes. Specific examples of the standard grain size charts are shown in "Annex B (normative), Measurement of Grain Size-Standard Grain Size Chart" of "Microscopic Test Method of Steel-Grain Size" as specified in Non-Patent Document 1 (Japan Industrial Standards JIS G 0551, Japan Standards Institute, revised on Jan. 21, 2013). The microscopic test method for the steel-grain size mentioned in the above-mentioned JIS is substantially the same as the "ISO 643:2012 Microscopic Test Method of Steel-Grain Size (Steels-Micrographic determination of the apparent grain size)", (Switzerland), 3rd Edition, International Organization for Standardization, 2012.

In the present specification, the term "grain size number" refers to a value of G calculated by the following formula using the average number m of crystal grains per square millimeter of cross-sectional area. For example, when m is 16, the grain size number G is 1. The smaller the grain size number, the coarser the grain size, and conversely, the larger the grain size number, the finer the grain size.

$$m=8\times2^{G} \quad \text{[Formula 1]}$$

The comparison between the metallographic photograph and the standard grain size chart is performed, specifically, by comparing a micrograph showing the metallographic structure of a black heart malleable cast iron with the standard grain size chart illustrated at the same magnification as that of the micrograph, and then visually identifying the grain size number of the standard grain size chart that illustrates the grain size most similar to the grain size shown in the micrograph. In this comparison, the lump graphite parts included in the micrograph are ignored, whereby the comparison with the standard grain size chart is performed focusing only on the size of the grain boundary of the ferrite matrix.

In the present specification, the term "metallographic photograph" is not limited to a micrograph which is formed by printing a metallographic structure on paper, and may be image data or the like obtained by using a CCD camera installed in a metallographic microscope.

The grain size of the matrix mentioned above is inherent to the black heart malleable cast iron according to the present invention. In the prior art, there is no technique which enables the production of black heart malleable cast iron having such metallographic features.

In a black heart malleable cast iron according to the prior art, lump graphite is not necessarily present at the position of the crystal grain boundary of the matrix, and is often present at a position near the center of the crystal grain of the matrix, distant from the crystal grain boundary of the matrix, or is often present across a plurality of crystal grain boundaries of the matrix. In addition, the grain size of the matrix may be often 7.5 or less in terms of grain size number. In the case of such a metallographic structure, carbon atoms must migrate through the matrix for a long distance by their diffusion until they are precipitated as lump graphite in the graphitization process. In some cases, the carbon atoms must migrate across a plurality of crystal grains of the matrix. Therefore, the completion of the graphitization process takes a long time of several hours to several tens of hours.

Meanwhile, in the black heart malleable cast iron according to the present invention, the grain size of the final product, i.e., the matrix obtained after the completion of graphitization is 8.0 or more in the grain size number. The crystal grains of this matrix are finer than those of the conventional black heart malleable cast iron. In the black heart malleable cast iron having such a metallographic structure, during the manufacturing process of the black heart malleable cast iron, carbon atoms migrate due to their diffusion over a distance from the center of the refined matrix grain to the position of the corresponding crystal grain boundary at the longest to thereby reach the position of the crystal grain boundary, where the carbon atoms can be precipitated as graphite.

The diffusion rate of carbon atoms at the grain boundaries of the matrix is higher than the diffusion rate of carbon atoms in the crystal grains. In the black heart malleable cast iron according to the present invention, during the manufacturing process of the black heart malleable cast iron, carbon atoms necessary for precipitation and growth of the lump graphite, which is to be present at the positions of the crystal grain boundaries of the matrix, can be supplied to the lump graphite at high speed through the crystal grain boundaries of the matrix. In this way, by shortening the migration distance of carbon atoms due to their diffusion and making the crystal grain boundary usable as a diffusion path, the black heart malleable cast iron according to the present invention can significantly shorten the time required for the graphitization, as compared with the prior art.

When the grain size of the matrix is 8.0 or more in the grain size number, the migration distance of carbon atoms due to their diffusion until graphite is precipitated can be shortened, which can exhibit the effect of shortening the graphitization time. The finer the grain size of the matrix is, the better the black heart malleable cast iron becomes. Due to this, there is no upper limit of the grain size number. However, the grain size number of the matrix that can be formed in the black heart malleable cast iron according to the present invention does not exceed 10.0, even though it is extremely large. Thus, the grain size of the matrix in the present invention is 8.0 or more and 10.0 or less in the grain size number. The grain size number is preferably 8.5 or more.

In a preferred embodiment, the black heart malleable cast iron according to the present invention is configured such that the lump graphite is present at the position of the grain boundary of the matrix. In the present specification, the expression "lump graphite is present at the position of the grain boundary of the matrix" means that the lump graphite is present at both or either of the position located in the grain boundary between two ferrite crystal grains of the matrix and the position located in the grain boundary triple junction of three ferrite grains, in the metallographic structure of the black heart malleable cast iron as the final product. Lump graphite is hardly present across a plurality of grain boundaries of the matrix. Most of the lump graphite may be present at the positions of the crystal grain boundaries of the matrix. For example, when observing a micrograph, such as that shown in FIG. 1 mentioned later, 70 area % or more of the total area of the lump graphite in the micrograph is preferably present at the positions in the crystal grain boundaries of the matrix. The proportion of the lump graphite present at the positions of the grain boundaries in the total lump graphite is more preferably 80 area % or more, more preferably 90 area % or more, and most preferably 100 area %. The present invention can allow the situation where a small amount of lump graphite is present at positions near the centers of the grains of the matrix away from the crystal grain boundaries of the matrix, or the situation where a small amount of lump graphite is present across four or more crystal grain boundaries of the matrix.

Moreover, as used in the present specification, the expression "the lump graphite is present while being dispersed" means that the lump graphite is not present mostly at specific positions of the crystal grains located in parts of the matrix, but that the lump graphite is uniformly present at the positions of many crystal grains of the matrix. In other words, with regard to many crystal grains of the matrix, lump graphite is present at the positions of the crystal grain boundaries between the crystal grain and its surrounding crystal grains. The number of crystal grains with no lump graphite present at the corresponding crystal grain boundary is small. The lump graphite may be present in many crystal grains of the matrix. In such a case, the present invention can allow the situation where no lump graphite is present in the small number of crystal grains or where lump graphite, if any, is present at the position near the center of the crystal grain rather than the corresponding crystal grain boundary.

When a precipitate is present at the position of a crystal grain boundary of the matrix, interphase boundaries are formed between the matrix and the precipitate. In general, the grain boundary energies at the interphase boundaries are smaller than the grain boundary energies at grain boundaries between the same phases. When small crystal grains are integrated with large crystal grains in the matrix to grow together, the movement of crystal grain boundaries is essential. However, in order for the crystal grain boundaries to move away from the position of the precipitate, a new crystal grain boundary must be formed instead of the interphase boundaries, which requires more energy to move the grain boundaries, compared to the case where any precipitate is not present. For this reason, the crystal grain boundaries are fixed to the position of the precipitate without moving, which inhibits the growth of grains. Such an effect is sometimes called "pinning effect" of grain boundaries exhibited by precipitates.

In the black heart malleable cast iron according to the present invention, when the lump graphite is present at the positions of the grain boundaries of the matrix, the growth of crystal grains in the matrix during the graphitization process is inhibited by the pinning effect. Also, when the lump graphite is present while being dispersed at the positions of the grain boundaries of the matrix, the pinning effect is exhibited for most of crystal grains. As a result, the metallographic structure having a matrix with the grain size inherent to the black heart malleable cast iron according to the present invention is more likely to be formed.

In a preferred embodiment, in the black heart malleable cast iron according to the present invention, the average particle diameter of particles of the lump graphite is 10 micrometers or more and 40 micrometers or less. When the average particle diameter of particles of the lump graphite is 10 micrometers or more, the number of particles of the lump graphite does not increase so much, and thus the particles of the lump graphite tend to be easily present while being dispersed at the positions of the crystal grain boundaries of the matrix. On the other hand, when the average particle diameter of particles of the lump graphite is 40 micrometers or less, the number of particles of the lump graphite does not decrease so much, and thus the diffusion distance of carbon required for the growth of the lump graphite does not become so long. Thus, the time required for the graphitization tends to be easily shortened. Therefore, in the black heart malleable cast iron according to the present invention, the average particle diameter of particles of the lump graphite is preferably 10 micrometers or more and 40 micrometers or less. The average particle diameter of particles of the lump graphite is more preferably 12.0 micrometers or more and even more preferably 15.0 micrometers or more. The average particle diameter of particles of the lump graphite is more preferably 19.0 micrometers or less, even more preferably 18.5 micrometers or less, and still more preferably 18.0 micrometers or less.

In a preferred embodiment, in the black heart malleable cast iron according to the present invention, the number of particles of the lump graphite is 200 or more particles and 1,200 or less particles per square millimeter of the cross-sectional area thereof. Since the volume of graphite finally contained in the black heart malleable cast iron according to the present invention is substantially the same between the final cast irons, the larger the average particle diameter of particles of the lump graphite, the smaller the number of particles thereof, while the smaller the average particle diameter thereof, the larger the number thereof. When the number of particles of the lump graphite is 200 or more, the diffusion distance of carbon required for the growth of the lump graphite is shortened, so that the time required for the graphitization tends to be easily shortened. The larger the number of particles of the lump graphite is, the better the black heart malleable cast iron becomes. Due to this, there is no upper limit to the number of particles. However, the number of particles of the lump graphite per square millimeter of the cross-sectional area thereof, which graphite can be formed in a preferred embodiment of the present invention, does not exceed 1,200 at most. Therefore, the number of particles of the lump graphite per square millimeter of the cross-sectional area thereof is preferably 200 or more and 1,200 or less. The number of particles of the lump graphite per square millimeter of the cross-sectional area thereof is more preferably 300 or more and even more preferably 500 or more, and may be 1000 or less.

The average particle diameter and the number of particles of the lump graphite per square millimeter of the cross-sectional area thereof are measured through computer image analysis by creating data about an image of the micrograph, using a scanner, a CCD camera, or the like, as mentioned later in Examples. This micrograph used here is the micrograph showing the metallographic structure of the black heart malleable cast iron used for identifying the grain size number.

It should be noted that all of the grain size number, the average grain size, and the number of particles mentioned in the above description of the black heart malleable cast iron according to the present invention are measured values about the metallographic structure of the black heart malleable cast iron obtained after the completion of the graphitization process. The operations and effects of the present invention, such as the suppression of crystal grain growth and the shortening of the time required for graphitization, are exhibited mainly at an intermediate stage in progress of the graphitization process. However, it is difficult to numerically evaluate the metallographic structure at the intermediate stage of such a process. This is why the numerical values regarding the metallographic structure obtained after the completion of the graphitization process are substituted, for convenience.

[Alloy Composition]

An alloy composition of the black heart malleable cast iron according to the present invention will be described. In the present specification, all the contents of respective elements are expressed in % by mass, which means a mass percentage.

In a preferred embodiment, the black heart malleable cast iron according to the present invention contains 2.0% by mass or more and 3.4% by mass or less of carbon. When the carbon content is 2.0% by mass or more, the melting point of the molten metal used for casting to produce the black heart malleable cast iron becomes 1400° C. or lower, which eliminates the need to heat a raw material to a high temperature for manufacturing the molten metal, so that the black heart malleable cast iron tends to obviate a large-scale melting facility. At the same time, the viscosity of the molten metal becomes low, allowing the molten metal to easily flow, so that the molten metal is apt to be easily poured into the casting mold. When the carbon content is 3.4% by mass or less, mottle is less likely to be formed at the time of casting and during the cooling process thereafter. Therefore, the carbon content is preferably 2.0% by mass or more and 3.4% by mass or less. More preferably, the carbon content is 2.5% by mass or more and 3.2% by mass or less.

In a preferred embodiment, the black heart malleable cast iron according to the present invention contains 0.5% by mass or more and 2.0% by mass or less of silicon. When the silicon content is 0.5% by mass or more, the effect of promoting graphitization by silicon is obtained, so that the graphitization tends to be easily completed in a short time. When the silicon content is 2.0% by mass or less, the effect of promoting graphitization by silicon does not become excessive, so that mottle is less likely to be formed at the time of casting and during the cooling process thereafter. Therefore, the silicon content is preferably 0.5% by mass or more and 2.0% by mass or less. The silicon content is more preferably 1.0% by mass or more and 1.7% by mass or less.

The black heart malleable cast iron according to the present invention includes at least one selected from the group consisting of:

(i) 0.0050% by mass or more and 0.15% by mass or less of bismuth and 0.020% by mass or more of manganese; and (ii) 0.0050% by mass or more and 1.0% by mass or less of aluminum and 0.0050% by mass or more of nitrogen.

That is, the black heart malleable cast iron according to the present invention includes at least one selected from the group consisting of (i) and (ii), and may include both (i) and (ii) in some cases.

By containing at least one selected from the group consisting of a combination of bismuth and manganese and a combination of aluminum and nitrogen as mentioned above, crystal grains can be miniaturized or refined. When the black heart malleable cast iron contains bismuth and manganese, the bismuth content is 0.0050% by mass or more, and the manganese content is 0.020% by mass or more. The content of bismuth is preferably 0.0060% by mass or more, more preferably 0.0070% by mass or more, and even more preferably 0.0080% by mass or more. The manganese content is preferably 0.10% by mass or more. On the other hand, if the bismuth content is extremely high, mottle may be formed. Therefore, the bismuth content is 0.15% by mass or less, preferably 0.10% by mass or less, more preferably 0.050% by mass or less, and even more preferably 0.020% by mass or less.

In a preferred embodiment, in the black heart malleable cast iron according to the present invention, a manganese content may be 0.50% by mass or less. When the manganese content is 0.50% by mass or less, there is a tendency that the black heart malleable cast iron is prevented in advance from reducing its toughness due to pearlite that remains in the matrix made of ferrite after annealing, or that inhibition of graphitization is prevented in advance. Therefore, the manganese content is preferable 0.50% by mass or less. Manganese does not affect graphitization when binding to sulfur to form a manganese sulfide. Thus, the influence on graphitization can be suppressed by keeping a good balance between manganese and sulfur in the molten metal. When a cupola furnace is used to melt the raw material, sulfur is supplied from coke of fuel. The manganese content is more preferably 0.35% by mass or less and even more preferably 0.30% by mass or less.

When the black heart malleable cast iron contains aluminum and nitrogen, the aluminum content is 0.0050% by mass or more, and the nitrogen content is 0.0050% by mass or more. The aluminum content is preferably 0.0060% by mass or more and more preferably 0.0065% by mass or more. The nitrogen content is preferably 0.0060% by mass or more, more preferably 0.0070% by mass or more, and even more preferably 0.0080% by mass or more. On the other hand, if the content of aluminum is extremely high, mottle may be formed. Therefore, the aluminum content is 1.0% by mass or less, preferably 0.10% by mass or less, more preferably 0.050% by mass or less, and even more preferably 0.020% by mass or less. If the nitrogen content is extremely high, graphitization is inhibited, so that the nitrogen content is preferably 0.015% by mass or less and more preferably 0.010% by mass or less. When either of aluminum and nitrogen is contained in an excessive amount, the excessive aluminum or nitrogen does not significantly contribute to the refinement of crystal grains. To efficiently form aluminum nitride, preferably, the aluminum content (% by mass) is approximately twice the content (% by mass) of nitrogen.

Among the combination of bismuth and manganese and the combination of aluminum and nitrogen, from the viewpoint of stably obtaining the effect of grain refinement, aluminum and nitrogen are preferably contained in the black heart malleable cast iron.

In a preferred embodiment, the black heart malleable cast iron according to the present invention may contain 0.0050% by mass or more and 1.0% by mass or less in total of one or two elements selected from the group of elements consisting of bismuth and aluminum.

The black heart malleable cast iron according to the present invention does not increase the content of any element that promotes graphitization of carbon, silicon, and the like. In addition, the upper limits of the contents of bismuth and aluminum are set. Consequently, the formation of mottle at the time of the casting and during the cooling process thereafter is suppressed, so that manufacturing process of the black heart malleable cast iron tends to be stably operated with less occurrence of defective products.

In the black heart malleable cast iron according to the present invention, as mentioned above, when this cast iron contains a predetermined amount of a combination of bismuth and manganese and/or a predetermined amount of a combination of aluminum and nitrogen, the metallographic structure composed of fine crystal grains that have the grain size number of 8.0 or more and 10.0 or less can be formed more easily, compared to the case where the predetermined amount of these elements is not contained. Although the reason for this is not clear, it is presumed that by adding these specific elements, the precipitation of graphite is promoted, which forms the metallographic structure that has a grain size of the ferrite matrix of 8.0 or more and 10.0 or less in the grain size number. The formation mechanism of such a metallographic formation is considered in detail as follows.

From the results of comparative experiments obtained so far, it is found that among minor elements contained in the black heart malleable cast iron, when (i) large contents of bismuth and manganese are contained therein or when (ii) large contents of aluminum and nitrogen are contained therein, the grain size of the matrix was remarkably miniaturized or refined and the boron content has little influence on the grain size. It is also been found that the contents of carbon and silicon do not significantly affect the grain size of the matrix, even though these elements are not minor elements. In the above cases (i) and (ii), the reason why the grain size of the matrix becomes fine is considered to be based on the following mechanism. It is noted that the following mechanism is inferred by the inventors based on the obtained experimental results and does not limit the technical scope of the present invention.

First of all, as mentioned in the above-mentioned case (ii), when the black heart malleable cast iron contains large amounts of aluminum and nitrogen, it is presumed that fine particles of aluminum nitride (AlN) are dispersed and precipitated in preheating, and in the subsequent graphitization, graphite that has a hexagonal crystal form similar to that of aluminum nitride is finely precipitated with a fine crystal of aluminum nitride serving as a nucleus.

Steel materials are known to have the effect of suppressing secondary recrystallization by precipitation of aluminum nitride. In addition, the precipitation rate of aluminum nitride is also known to be less temperature-dependent than the rate of recrystallization. Due to this, when the temperature of a steel material is maintained at a relatively low temperature, aluminum nitride can be precipitated before the occurrence of recrystallization. On the other hand, when the temperature rising rate of the steel material is high, recrystallization occurs before aluminum nitride is precipitated, thus coarsening crystal grains. Similarly, in graphitization of a black heart malleable cast iron, the precipitation of aluminum nitride by preheating at a low temperature is also considered to be related to the refinement of the grain size of the matrix in the present invention. Furthermore, the inventors have confirmed through another experiment that the refinement of crystal grains does not occur even when cast iron, which has once been heated to a temperature equal to or higher than a preheating temperature, is then preheated. This experimental result is consistent with the above-mentioned presumption.

Moreover, the inventors have separately confirmed that no refinement of a matrix is observed in a test that involves adding titanium thereto together with aluminum and nitrogen. It is presumed that the reason why the matrix is not refined in this test is that titanium nitride is preferentially formed as it is more stable than aluminum nitride, resulting in shortage of nitrogen for forming aluminum nitride, so that no aluminum nitride is formed.

Next, as mentioned in the above-mentioned case (i), when the black heart malleable cast iron contains large amounts of bismuth and manganese, it is presumed that a hexagonal intermetallic compound of bismuth and manganese becomes a formation nucleus of graphite at the preheating temperature. Manganese is a minor element that is normally present in cast iron, for example, when it is molten in a cupola furnace. The inventors have confirmed through another experiment that the effect of the present invention cannot be obtained by preheating the raw material at 500° C. or higher. This experimental result is consistent with decomposition of manganese bismuth at approximately 500° C.

It is noted that instead of bismuth and aluminum mentioned above, for example, an element having properties similar to those of bismuth, such as tellurium or antimony, could be proposed to be used. However, these elements are known to be doubtfully toxic to the human body. Therefore, these elements are not added instead of bismuth and aluminum in the present invention. Even if they are accidentally included as inevitable impurities, the content of these elements should be restricted within the total content of inevitable impurities listed below.

The black heart malleable cast iron according to the present invention may further contain more than 0% by mass and 0.010% by mass or less of boron. In the present specification, the expression "the content of an element is more than 0% by mass" means that the element is contained in the minimum amount (e.g., 0.001% by mass) or more, which can be detected by usual analysis means. The inclusion of boron in the black heart malleable cast iron makes it possible to shorten the graphitization time. To exhibit this effect, the boron content is preferably 0.0025% by mass or more, and more preferably 0.0030% by mass or more. If the boron content is extremely high, there occur inconveniences, such as degraded elongation of the cast iron. Thus, the boron content is preferably 0.010% by mass or less.

The black heart malleable cast iron according to the present invention contains balance being iron and inevitable impurities, in addition to the above-mentioned elements. Iron is a major element of the black heart malleable cast iron. The inevitable impurities include: trace metal elements, such as chromium, sulfur, oxygen, and nitrogen, originally contained in the raw material; compounds, such as oxides, mixed into the iron from a furnace wall in the manufacturing process; and compounds, such as oxides, generated by a reaction between a molten metal and atmospheric gas. These inevitable impurities do not significantly change their properties if 1.0% by mass or less in total of these elements is contained in the black heart malleable cast iron. However, the preferable total content of the inevitable impurities is 0.5% by mass or less.

[Manufacturing Method]

A method for manufacturing a black heart malleable cast iron according to the present invention will be described.

In a second embodiment of the present invention, a method for manufacturing a black heart malleable cast iron comprises the step of casting a casting material to produce a cast metal comprising 2.0% by mass or more and 3.4% by mass or less of carbon, 0.5% by mass or more and 2.0% by mass or less of silicon, and at least one selected from the group consisting of:

(i) 0.0050% by mass or more and 0.15% by mass or less of bismuth, and 0.020% by mass or more of manganese, and (ii) 0.0050% by mass or more and 1.0% by mass or less of aluminum and 0.0050% by mass or more of nitrogen, the balance being iron and inevitable impurities. The content of each element specified herein represents the content thereof in the final product subjected to the casting, preheating and graphitization steps, similarly to the black heart malleable cast iron according to the present invention. The reason for restricting the composition range of each element has already been mentioned, and thus the description thereof is omitted here.

The contents of bismuth, manganese, aluminum, nitrogen, carbon, silicon, and boron mentioned above can be adjusted by adding a metal or a compounded form thereof, or alternatively or additionally can be adjusted by using a raw material already containing the above elements, such as the use of steel scrap or the reuse of cast iron. Thus, the raw material used for casting may include carbon, silicon, bismuth, aluminum, manganese, and elemental iron. Alternatively, with regard to carbon, silicon, and aluminum, an alloy of each or any one of them and iron may be used. Other compounds of bismuth and the like, such as oxides, nitrides, carbides, borides, or composite compounds thereof, may be used. As the raw material of iron, the above-mentioned steel scrap or the like can also be used. Furthermore, the above-mentioned cast iron can be reused. When using a steel scrap or the like as the raw material of iron, since general steel materials contain carbon and silicon, these elements can often be adapted to the composition range specified in the present invention, only by melting the steel scrap. The steel scrap and the reused cast iron may contain bismuth, aluminum, and manganese, in addition to the above-mentioned carbon and silicon. When a large amount of the above-mentioned bismuth or the like is contained in the steel scrap or the reused cast iron, a black heart malleable cast iron that contains the amount of bismuth specified in the present invention can be produced without adding any other bismuth or the like. Nitrogen can be contained in the molten steel due to atmospheric melting, but may be further added in the form of nitride or the like when it is insufficient.

Among the above-mentioned elements, bismuth and aluminum are elements that has so high vapor pressure and thus are easily evaporated and lost from the surface of a molten metal. Therefore, since the contents of bismuth and aluminum gradually decrease during the period of time from the start of the melting of the raw material to the completion of the casting or in the graphitization process, larger amounts of bismuth and aluminum are preferably contained in the cast iron by predicting the decreased amounts of bismuth and aluminum. Bismuth and aluminum may be added to the molten metal immediately before casting. Specifically, for example, bismuth and aluminum are preferably added when the molten metal is discharged from a melting facility into a ladle for pouring the molten metal. It should be noted that the above-mentioned cast metal has substantially the same chemical composition as the black heart malleable cast iron as the final product.

Well-known means, such as a cupola furnace or an electric furnace, can be used to melt the raw material and prepare a molten metal. In the method for manufacturing a black heart malleable cast iron according to the present invention, since the carbon content is more than 2.0% by mass, the temperature required for melting the raw material does not exceed 1400° C. Therefore, a large-scale melting facility with an arrival temperature exceeding 1400° C. is not required. In the case of melting the raw material in the cupola furnace, the raw material containing a large amount of manganese as an inevitable impurity may be used in some cases. In this case, the black heart malleable cast iron that contains the amounts of bismuth and manganese specified in the present invention can be manufactured without adding any other manganese.

The method for manufacturing a black heart malleable cast iron according to the present invention includes the step of casting a casting material to produce a cast metal. In the manufacturing method according to the present invention, well-known casting molds, such as a mold formed by mold sand and a metal mold, can be employed as the mold for use in casting.

The method for manufacturing a black heart malleable cast iron according to the present invention comprises the step of preheating the resultant cast metal at a temperature of 275° C. or higher and 425° C. or lower. In the present specification, the term "preheating" refers to heat treatment performed on the cast metal in a low temperature range prior to the graphitization. The preheating temperature and the graphitization temperature mentioned later in the present specification are temperatures near the center of the cast iron. When the preheating temperature is 275° C. or higher and 425° C. or lower, the lump graphite tends to be easily dispersed and present at the positions of the crystal grain boundaries of the matrix. Consequently, this forms the metallographic structure of the black heart malleable cast iron according to the present invention, in which the grain size of the matrix is 8.0 or more and 10.0 or less in terms of grain size number, so that the effect of shortening the graphitization time can be obtained. Therefore, the preheating temperature is set to 275° C. or higher and 425° C. or lower. The preheating temperature is preferably 300° C. or higher and more preferably 320° C. or higher. The preheating temperature is preferably 420° C. or lower and more preferably 410° C. or lower. The preheating is performed on the cast metal obtained by casting as mentioned above and then cooling to the room temperature. The cast metal is obtained by breaking the cooled mold after the casting.

In the present specification, the expression "the cast metal is preheated at a temperature of 275° C. or higher and 425° C. or lower" includes both the case where the temperature of the cast metal is maintained at a constant temperature within the temperature range of 275° C. or higher and 425° C. or lower, and the case where the temperature of the cast metal passes through the temperature range of 275° C. or higher and 425° C. or lower in the process of changing the temperature of the cast metal from a low temperature to a high temperature. In either case, the temperature of the cast metal can be allowed to drop or rise within the temperature range of 275° C. or higher and 425° C. or lower as mentioned above.

When the temperature of the cast metal is changed from a low temperature to a high temperature in the preheating as mentioned above, the average temperature rise rate within the temperature range of 275° C. or higher and 425° C. or lower is preferably 3.0° C./minute or less, more preferably 2.8° C./minute or less, and still more preferably 2.5° C./minute or less.

In the case where the cast metal is preheated before graphitization, similarly to the method for manufacturing a black heart malleable cast iron according to the present invention, the metallographic structure composed of fine crystal grains that have the grain size number of 8.0 or more and 10.0 or less can be formed more easily, compared to the case where the preheating is not performed. The reason for this is considered to be based on the above-mentioned mechanism. As mentioned in Patent Document 3 cited above, since the preheating temperature in the present invention is lower than the temperature at which decomposition of cementite starts, obvious changes, such as precipitation of graphite, are not observed in the metallographic structure after the preheating and before the graphitization. According to the mechanism mentioned above, it is presumed that through the preheating, the cast metal undergoes changes in terms of metallography, which forms the metallographic structure of the black heart malleable cast iron according to the present invention after the graphitization.

In a preferred embodiment, in the method for manufacturing a black heart malleable cast iron according to the present invention, the time for preheating the cast metal at a temperature of 275° C. or higher and 425° C. or lower in the preheating step is 30 minutes or more and 5 hours or less. When the preheating time is 30 minutes or more, the effect of the preheating tends to be easily obtained. When the preheating time is 5 hours or less, the total heat treatment time including the graphitization time can be shortened. Therefore, the preheating time is preferably 30 minutes or more and 5 hours or less. A more preferable upper limit of the preheating time is 3 hours or less.

The method for manufacturing a black heart malleable cast iron according to the present invention further includes the step of graphitizing the cast metal at a temperature exceeding 680° C. after the preheating. After the preheating, the cast metal may be heated so that its temperature is raised from the preheating temperature to the graphitization temperature, or may be once cooled to room temperature and then heated so that its temperature is raised to the graphitization temperature. In the manufacturing method according to the present invention, a known heat treatment furnace, such as a gas combustion furnace or an electric furnace, can be used as means for performing the graphitization.

The graphitization is the process specific to the method for manufacturing a black heart malleable cast iron. In the graphitization step, a product after the preheating is heated to a temperature exceeding 680° C. and then 720° C. corresponding to the Al transformation point to decompose cementite, thus precipitating graphite. In addition, the matrix made of austenite is cooled to transform the austenite into ferrite, thereby making it possible to impart toughness to the cast metal. The step of graphitizing the cast metal is divided into a first stage graphitization and a second stage graphitization performed after the first stage graphitization. Preferably, the graphitization step preferably includes the first stage graphitization which includes heating at a temperature exceeding 900° C., and the second stage graphitization in which a start temperature of 720° C. or higher and 800° C. or lower, and a completion temperature is 680° C. or higher and 720° C. or lower.

The first stage graphitization is the step of decomposing cementite in austenite within the temperature range exceeding 900° C. to precipitate graphite. Carbon produced by decomposing the cementite in the first stage graphitization contributes to the growth of the lump graphite. The temperature at which the first stage graphitization is performed is preferably 950° C. or higher and 1100° C. or lower. A more preferable temperature range is 980° C. or higher and 1030° C. or lower.

In the method for manufacturing a black heart malleable cast iron according to the present invention, the time for performing the first stage graphitization can be significantly shortened by the effect of the present invention, as compared with the prior art. The actual time for the first stage graphitization can be appropriately determined depending on the size of an annealing furnace, the amount of cast metal to be processed, and the like. The time required for the first stage graphitization in the prior art takes several hours or more, whereas the time required for the first stage graphitization in the present invention takes at most 3 hours, typically 1 hour or less, which is sufficient. Depending on the conditions of the graphitization, the first stage graphitization in the present invention can be completed even in 45 minutes or less in excess of 30 minutes.

The second stage graphitization is the step of decomposing the cementite in the pearlite within the temperature range that is below the temperature at which the first stage graphitization is performed, thereby precipitating graphite and ferrite. The second stage graphitization is preferably performed while gradually decreasing the temperature of the cast metal from a second stage graphitization start temperature to a second stage graphitization completion temperature in order to promote the growth of the lump graphite and ensure the transformation from austenite to ferrite. The average cooling rate from the second stage graphitization start temperature to the second stage graphitization completion temperature is more preferably 1.5° C./minute or less, more preferably 1.0° C./minute or less. From the viewpoint of growth of the lump graphite and transformation to ferrite, the lower the average cooling rate is, the better the cast iron becomes. However, from the viewpoint of ensuring productivity, the lower limit of the average cooling rate may be set to approximately 0.20° C./minute.

The second stage graphitization start temperature is preferably 720° C. or higher and 800° C. or lower. A more preferable temperature range of the second stage graphitization start temperature is 740° C. or higher and 780° C. or lower. The second stage graphitization completion temperature is a temperature of 680° C. or higher and 720° C. or lower and is preferably a temperature that is lower than the second stage graphitization start temperature. A more preferable temperature range of the second stage graphitization completion temperature is 690° C. or higher and 710° C. or lower.

In the method for manufacturing a black heart malleable cast iron according to the present invention, the time for performing the second stage graphitization can be significantly shortened by the effect of the present invention, as compared with the prior art. The actual time for the second stage graphitization can be appropriately determined depending on the size of the annealing furnace, the amount of cast metal to be processed, and the like. The time required for the second stage graphitization in the prior art takes several hours or more, similarly to the first stage graphitization in the prior art, whereas the time required for the second stage graphitization in the present invention takes at most 3 hours and typically suffices for 1 hour or less. Depending on the conditions of the graphitization, the second stage graphitization in the present invention can also be completed even in 45 minutes or less in excess of 30 minutes.

In a preferred embodiment, in the method for manufacturing a black heart malleable cast iron according to the present invention, the time for graphitizing the cast metal at a temperature exceeding 680° C. in the graphitization step is 30 minutes or more and 6 hours or less in total. In the present specification, the "time for graphitizing the cast metal at a temperature exceeding 680° C." refers to the total time of the time for maintaining the temperature of the cast metal at the first graphitization temperature and the time for maintaining the temperature of the cast metal at the second graphitization temperature. The total graphitization time is preferably 5 hours or less, and more preferably 3 hours or less. The above-mentioned time refers to the period of time that elapses after a part near the center of the casting reaches the above-mentioned temperature range.

The method for manufacturing a black heart malleable cast iron according to the present invention is a method for manufacturing a black heart malleable cast iron that has the above-mentioned metallographic structure and chemical composition. The black heart malleable cast iron manufactured by the method for manufacturing black heart malleable cast iron according to the present invention, in particular, the black heart malleable cast iron after the graphitization step includes the matrix of ferrite and the lump graphite contained in the matrix, and contains the above-mentioned amount of a combination of bismuth and manganese, and/or a combination of aluminum and nitrogen. In addition, the grain size of the matrix is 8.0 or more and 10.0 or less in terms of the grain size number, numerically determined by comparison between the metallographic photograph thereof and the standard grain size chart. In a preferred embodiment, the average particle diameter of particles of the lump graphite is 10 micrometers or more and 40 micrometers or less.

<Others>

The influences of the alloy composition and the manufacturing method on the metallographic structure of the black heart malleable cast iron according to the present invention will be described.

The black heart malleable cast iron according to the present invention has the features of the metallographic structure that it has the matrix of ferrite and the lump graphite contained in the matrix and that the grain size of the matrix is 8.0 or more and 10.0 or less in terms of the grain size number numerically determined by the comparison between the metallographic photograph thereof and the standard grain size chart. In addition, the black heart malleable cast iron has the features of the components that it contains at least one selected from the group consisting of (i) 0.0050% by mass or more and 0.15% by mass or less of bismuth, and 0.020% by mass or more of manganese, and (ii) 0.0050% by mass or more and 1.0% by mass or less of aluminum and 0.0050% by mass or more of nitrogen. These features are the essential subjects for specifying the present invention in the first embodiment.

In order to produce the black heart malleable cast iron having the above-mentioned features, the method for manufacturing the same needs to have the step of preheating the cast metal at a temperature of 275° C. or higher and 425° C. or lower. This condition is the condition that enables the present invention to be implemented. As mentioned above, the alloy composition of the black heart malleable cast iron includes at least one selected from the group consisting of (i) 0.0050% by mass or more and 0.15% by mass or less of bismuth, and 0.020% by mass or more of manganese, and (ii) 0.0050% by mass or more and 1.0% by mass or less of aluminum, and 0.0050% by mass or more of nitrogen.

EXAMPLES

First Example

In First Example, the influences of the presence or absence of a certain amount or more of bismuth and the presence or absence of preheating on the metallographic structure of the black heart malleable cast iron were examined. Only 700 kg of a molten metal obtained by blending the raw materials to contain 3.0% by mass of carbon and 1.5% by mass of silicon, the balance being iron and inevitable impurities, was dispensed into a ladle. Then, 210 g (0.030% by mass) of bismuth was added to the molten metal, followed by stirring, and immediately poured into a casting mold, whereby the molten metal was cast to produce a cast metal. The resultant cast metal contained 0.01% by mass of bismuth and 0.35% by mass of manganese derived from the raw material in addition to the above-mentioned amounts of carbon and silicon.

Then, after the cast metal was preheated at 400° C. for 1 hour, the preheated cast metal was cooled to room temperature, then heated again from room temperature to 980° C. over 1.5 hours, and held for 1 hour, thereby performing the first stage graphitization. Hereinafter, also in Second to Sixth Examples below, in the case of performing the preheating, the cast metal was preheated, cooled to the room temperature, and then heated by raising the temperature of the cast metal from the room temperature to the graphitization temperature over 1.5 hours to 2 hours. Next, after cooling the cast metal down to 760° C., the cast metal was cooled from 760° C. to 720° C. over one hour, thereby performing the second stage graphitization. In this way, a sample of a black heart malleable cast iron of Example 1 was prepared.

It is noted that in First to Sixth Examples, the temperature of the cast metal was measured using a thermocouple. The measurement was carried out by arranging a temperature detecting portion of the thermocouple near the center of the cast metal.

After a cut surface of the obtained sample was polished and the grain boundaries thereon were etched with nital, the metallographic structure of the cut surface of the sample was observed with an optical microscope, and then a metallographic photograph thereof was taken with a CCD camera installed in the optical microscope. The taken metallographic photograph is shown in FIG. 1. The length of a scale bar shown in FIG. 1 is 200 micrometers. In each of Examples 1 to 6, the area ratio of ferrite to the entire metallographic structure was 80% or more.

As shown in FIG. 1, in the metallographic structure of the black heart malleable cast iron of Example 1, many particles of lump graphite were present at both or either of the position of a point in the crystal grain boundary located between two ferrite crystal grains of the matrix, and the position of the grain boundary triple junction of three ferrite grains. The lump graphite was hardly present across four or more grain boundaries of the matrix.

In addition, the lump graphite is not present mostly at specific positions of the crystal grains located in parts of the matrix, and it is uniformly present at the positions of many crystal grains of the matrix. More specifically, in most of crystal grains of the matrix, the lump graphite is present at the positions of the crystal grain boundaries between crystal grains and their surrounding crystal grains, and there are a small number of crystal grains that have no lump graphite at the positions of their crystal grain boundaries. That is, the lump graphite was present while being dispersed at the positions of the crystal grain boundaries of the matrix.

Then, the grain size of the ferrite matrix was measured by comparing the metallographic photograph shown in FIG. 1 with the standard grain size chart of Non-Patent Document 1. In this comparison, the lump graphite parts included in the metallographic photograph are ignored, whereby the comparison with the standard grain size chart is performed focusing only on the size of the grain boundary of the ferrite matrix. As a result, the grain size of the matrix was found to be 9.5 in terms of grain size number.

Then, after binarizing the image data of the metallographic photograph shown in FIG. 1 using image processing software (Quick Grain Pad+, manufactured by INNOTECH CORPORATION), the particle diameter and the number of particles of the lump graphite were measured. In the measurement, precipitates having a particle diameter of 10 micrometers or less were excluded from an object of the measurement so as not to erroneously measure trace impurities other than the lump graphite contained in the metallographic structure. As a result of the measurement, the average particle diameter of particles of the lump graphite was 15.1 micrometers, and the number of particles of the lump graphite per square millimeter of the cross-sectional area thereof was 1023.

Comparative Example 1

The cast metal that was obtained by the casting on the same conditions as the cast metal in First Example was heated over 5 hours so that its temperature was raised from room temperature to 980° C. without any preheating and then held for 3 hours, thereby performing the first stage graphitization. Subsequently, the cast metal was cooled to 760° C., and then further cooled from 760° C. to 720° C. over 3 hours, thereby performing the second stage graphitization. In this way, a sample of a black heart malleable cast iron of Comparative Example 1 was prepared. A metallographic photograph of the sample of Comparative Example 1 taken by the same method as in Example 1 is shown in FIG. 2.

Figure 2:
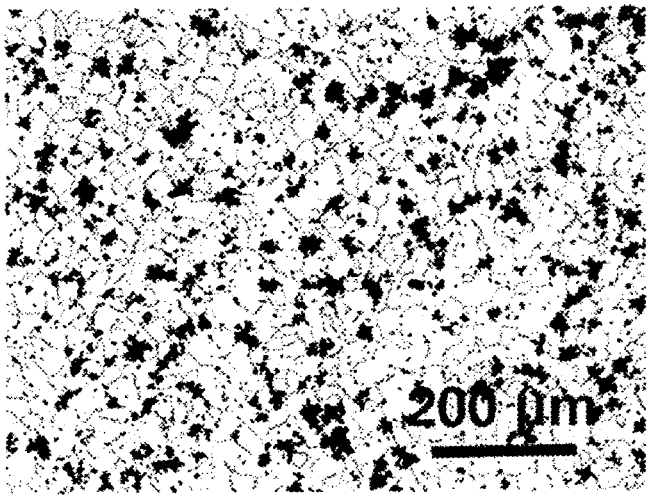
FIG. 2 is a metallographic photograph of a cast metal in Comparative Examples.

As shown in FIG. 2, in the metal structure of the black heart malleable cast iron of Comparative Example 1, many particles of the lump graphite may be agglomerated to form large lumps, and some of lumps of the lump graphite may be present across four or more crystal grain boundaries of the matrix. In addition, many particles of the lump graphite were present mostly at specific positions of the crystal grains located in parts of the matrix. Moreover, a great number of crystal grains that have no lump graphite present at the positions of their crystal grain boundaries were observed.

Next, when measuring the grain size of the ferrite matrix in the same way as in First Example, the grain size of the matrix was 7.5 in terms of grain size number. The average particle diameter of particles of the lump graphite measured by the same method as in First Example was 25.2 micrometers, and the number of particles of the lump graphite per square millimeter of the cross-sectional area thereof was 352.

Comparative Example 2

Only 700 kg of the same molten metal as the molten metal prepared in First Example was dispensed into a ladle and immediately poured into a mold without adding any other element, whereby the molten metal was cast to produce a cast metal. In this case, each of the contents of bismuth, aluminum, and nitrogen in the cast metal was below the corresponding content range specified in the present invention. Then, the cast metal was heated over 5 hours so that its temperature was raised from room temperature to 980° C. without any preheating and then held for 3 hours, thereby performing the first stage graphitization. Subsequently, the cast metal was cooled to 760° C., and then further cooled from 760° C. to 720° C. over 3 hours, thereby performing the second stage graphitization. In this way, a sample of a black heart malleable cast iron of Comparative Example 2 was prepared. A metallographic photograph of the sample of Comparative Example 2 taken by the same method as in Example 1 is shown in FIG. 3.

Figure 3:
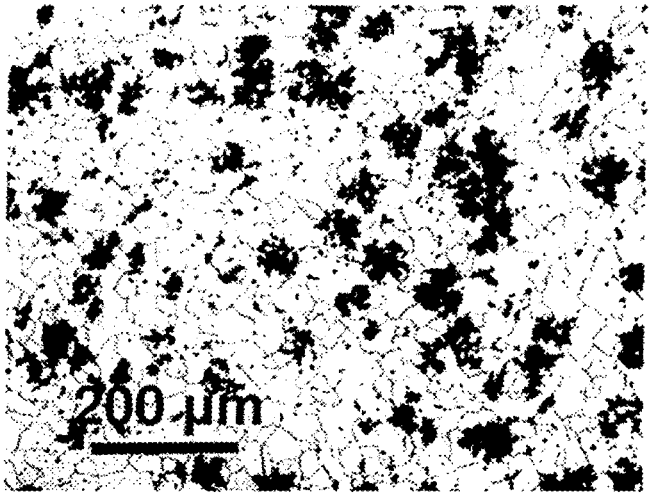
FIG. 3 is a metallographic photograph of a cast metal in Comparative Examples.

As shown in FIG. 3, in the metallographic structure of the black heart malleable cast iron of Comparative Example 2, many particles of the lump graphite may form large lumps, and some of lumps of the lump graphite may have a particle diameter exceeding the size of the grain size of the matrix. Many particles of the lump graphite were present across four or more crystal grain boundaries of the matrix. In addition, many particles of the lump graphite are presented mostly at specific positions of the crystal grains located in parts of the matrix. Moreover, a great number of crystal grains that have no lump graphite present at the positions of their crystal grain boundaries were observed. When measuring the grain size of the ferrite matrix in the same way as in First Example, the grain size of the matrix was 7.0 in terms of grain size number. When measuring the average particle diameter of particles of the lump graphite and the number of particles of the lump graphite per square millimeter of the cross-sectional area thereof in the same ways as in First Example, the average particle diameter of the lump graphite was 48.3 micrometers and the number of particles of the lump graphite per square millimeter of the cross-sectional area thereof was 73.

As can be seen from First Example mentioned above, the black heart malleable cast iron obtained by performing the preheating before the graphitization while containing a certain amount or more of bismuth and manganese has the metallographic structure specific to the black heart malleable cast iron according to the present invention. That is, the obtained specific metallographic structure is characterized in that the lump graphite is present while being dispersed at the positions of the grain boundaries of the matrix, and that the grain size of the matrix is 8.0 or more and 10.0 or less in terms of grain size number, numerically determined by comparison between the metallographic photograph and the standard grain size chart. The metallographic structure can be formed by preheating in a short time of only one hour. As a result, the time required for the graphitization can be significantly shortened, as compared with the prior art.

Second Example

In Second Example, the influences of the contents of a combination of bismuth and manganese and/or a combination of aluminum and nitrogen on the metallographic structure of the black heat malleable cast iron were examined. Only 700 kg of a molten metal obtained by blending the raw materials to contain 3.0% by mass of carbon and 1.5% by mass of silicon, the balance being iron and inevitable impurities, was dispensed into a ladle. Immediately after adding an additional element shown in Table 1 to the molten metal as a casting material and stirring them, the molten metal was poured into a casting mold, whereby the molten metal as the casting material was cast to produce a cast metal of each of Examples 2 and 3. In Comparative Example 3, no additive element was added to the casting material. It should be noted that these cast metals further contained 0.35% by mass of manganese and 0.007% by mass of insoluble nitrogen, which were derived from the raw material. In addition, as shown in Table 1, even when the additive element was not intentionally added, the cast metals of Examples 2 and 3 contained the respective amounts, indicated by the alloy composition of this table, of bismuth, aluminum, and boron, derived from the raw materials. The amount of the insoluble nitrogen was measured by an electrolytic extraction method. The amount of soluble nitrogen measured by bispirazolone absorption spectrophotometry was approximately 0.003% by mass, so that the total amount of nitrogen composed of the soluble nitrogen and the insoluble nitrogen was approximately 0.01% by mass.

Next, the cast metal was preheated at 400° C. over 5 hours. Then, the preheated cast metal was heated to 980° C. and held for 3 hours, thereby performing the first stage graphitization. Subsequently, the cast metal was cooled to 760° C., and then further cooled from 760° C. to 720° C. over 3 hours, thereby performing the second stage graphitization. In this way, a sample of a black heart malleable cast iron in each of Examples 2 and 3 was prepared. The alloy compositions of the obtained samples of Examples 2 and 3 and Comparative Example 3 was subjected to chemical analysis. Among all analyzed values, analyzed values of the elements except for iron and inevitable impurities as the balance are shown in Table 1.

TABLE 1

| | Amount of additive element (percentage by mass) | | | Alloy composition (percentage by mass) | | | | |
|---|---|---|---|---|---|---|---|---|
| Sample | Bi | Al | B | C | Si | Bi | Al | B |
| Example 2 | 0.0160 | No addition | No addition | 3.07 | 1.46 | 0.0090 | 0.0050 | 0.0023 |
| Example 3 | No addition | 0.0029 | No addition | 3.07 | 1.50 | 0.0020 | 0.0070 | 0.0020 |
| Comparative Example 3 | No addition | No addition | No addition | 3.03 | 1.52 | — | — | — |

Then, after the cut surface of the obtained sample was polished and the grain boundaries thereon were etched with nital, the metallographic structure of the cut surface of the sample was observed with an optical microscope. Table 2 respectively shows the evaluation result of the distribution state of the lump graphite in each sample and the result of measuring the grain size of the matrix of each sample in terms of grain size number by the same method as in First Example. In each of the samples of Example 2 and Example 3 with the results of "YES" mentioned in Table 2, the lump graphite was present while being dispersed at positions of the crystal grain boundaries of the matrix. In the sample of Comparative Example 3 with the result of "NO" mentioned in Table 2, many particles of the lump graphite were present across four or more crystal grain boundaries of the matrix. In addition, many particles of the lump graphite were present mostly at specific positions of the crystal grains located in parts of the matrix. Moreover, a great number of crystal grains that had no lump graphite present at the positions of their crystal grain boundaries were observed.

TABLE 2

| Sample | Distribution of lump graphite at crystal grain boundaries | Grain size (grain size number) | Tensile strength (MPa) | Elongation (%) | Average particle diameter of lump graphite (μm) | Number of particles of lump graphite (particles/mm$^2$) |
|---|---|---|---|---|---|---|
| Example 2 | YES | 8.5 | 295 | 8.7 | 16.6 | 768 |
| Example 3 | YES | 8.0 | 318 | 9.4 | 12.3 | 969 |
| Comparative Example 3 | NO | 7.5 | 304 | 6.3 | 23.2 | 294 |

Then, a test specimen for a tensile strength test was cut out of each sample of the black heart malleable cast irons, and the tensile strength of the test specimen was measured using a tensile strength tester. The obtained tensile strength and elongation value of each test specimen are shown in Table 2. As can be seen from Second Example mentioned above, the samples of the black heart malleable cast irons of Examples 2 and 3, which contain a certain amount or more of a combination of bismuth and manganese and a combination of aluminum and nitrogen, respectively, can have the metallographic structure specific to the present invention. That is, the obtained specific metallographic structure is characterized in that the lump graphite is present while being dispersed at the positions of the grain boundaries of the matrix, and that the grain size of the matrix is 8.0 or more and 10.0 or less in terms of grain size number, numerically determined by comparison between the metallographic photograph thereof and the standard grain size chart. In addition, it can be seen that these samples of Examples 2 and 3 increase their elongation in the tensile strength test, compared to the sample of Comparative Example 3 to which neither bismuth nor aluminum is added.

Third Example

In Third Example, particularly, the influences of inclusion of a combination of bismuth and manganese and/or a combination of aluminum and nitrogen, and inclusion of boron on the metallographic structure of the black heart malleable cast iron were examined. Only 700 kg of a molten metal obtained by blending the raw materials to contain 2.7% by mass of carbon and 1.1% by mass of silicon, the balance being iron and inevitable impurities, was dispensed into a ladle. Then, an additive element shown in Table 3 was added to the molten metal, followed by stirring, which was then immediately poured into the casting mold, whereby the molten metal was cast to produce a cast metal in each of Examples 4 to 6 and Comparative Example 4. No additive element was not added to the cast metal of Comparative Example 5. Each obtained cast metal was supposed to contain manganese and nitrogen derived from the raw materials within the range of content thereof specified by the present invention in addition to the elements shown in Table 3 below.

Then, the cast metal was preheated at 400° C. for 5 hours, then heated such that its temperature was raised to 980° C., and held for 3 hours, thereby performing the first stage graphitization. Subsequently, the cast metal was cooled to 760° C. and then cooled from 760° C. to 720° C. over 3 hours, thereby performing the second stage graphitization. In this way, samples of black heart malleable cast irons were prepared.

The alloy compositions of the obtained samples were subjected to chemical analysis. Among all analyzed values, analyzed values of the elements except for iron and inevitable impurities are shown in Table 3.

TABLE 3

| | Amount of additive element (percentage by mass) | | | Alloy composition (percentage by mass) | | | | |
|---|---|---|---|---|---|---|---|---|
| Sample | Bi | Al | B | C | Si | Bi | Al | B |
| Example 4 | 0.0300 | No addition | No addition | 2.76 | 1.13 | 0.0100 | 0.0040 | 0.0021 |
| Example 5 | No addition | 0.0057 | No addition | 2.63 | 1.12 | 0.0020 | 0.0070 | 0.0022 |
| Example 6 | 0.0300 | 0.0057 | 0.0080 | 2.73 | 1.13 | 0.0100 | 0.0060 | 0.0037 |
| Comparative Example 4 | No addition | No addition | 0.0080 | 2.76 | 1.13 | 0.0030 | 0.0030 | 0.0035 |
| Comparative Example 5 | No addition | No addition | No addition | 2.63 | 1.16 | 0.0020 | 0.0020 | 0.0022 |

Then, after the cut surface of the obtained sample was polished and the grain boundaries thereon were etched with nital, the metallographic structure of the cut surface of the sample was observed with an optical microscope. Table 4 respectively shows the evaluation result of the distribution state of the lump graphite in each sample and the result of measuring the grain size of the matrix of each sample in terms of grain size number by the same method as in First Example. In addition, a test specimen for a tensile strength test was cut out of each obtained sample, and the tensile strength of the test specimen was measured using a tensile strength tester. The obtained tensile strength and elongation value of each test specimen are shown in Table 4.

TABLE 4

| Sample | Distribution of lump graphite at crystal grain boundaries | Grain size (grain size number) | Tensile strength (MPa) | Elongation (%) | Average particle diameter of lump graphite (μm) | Number of particles of lump graphite (particles/mm$^2$) |
|---|---|---|---|---|---|---|
| Example 4 | YES | 8.0 | 301 | 11.7 | 20.1 | 372 |
| Example 5 | YES | 8.5 | 306 | 14.1 | 18.2 | 638 |
| Example 6 | YES | 9.0 | 310 | 14.7 | 12.6 | 1,056 |
| Comparative Example 4 | NO | 7.5 | 274 | 8.7 | 24.8 | 224 |
| Comparative Example 5 | NO | 7.0 | 279 | 4.9 | 40.2 | 56 |

As can be seen from Third Example mentioned above, the samples of the black heart malleable cast irons of Examples 4 to 6, which contain a certain amount or more of a combination of bismuth and manganese and/or a combination of aluminum and nitrogen can have the metallographic structure specific to the present invention. That is, the obtained specific metallographic structure is characterized in that the lump graphite is present while being dispersed at the positions of the grain boundaries of the matrix, and that the grain size of the matrix is 8.0 or more and 10.0 or less in terms of grain size number, numerically determined by comparison between the metallographic photograph and the standard grain size chart. In addition, it can be seen that these samples of Examples 4 to 6 have increased elongation in the tensile strength test, compared to the samples of Comparative Examples 4 and 5 to which neither bismuth nor aluminum is added. Moreover, it can also be seen that the addition of boron alone has no effect of refining crystal grains.

Fourth Example

In Fourth Example, the influences of the size of the cast metal and the conditions of preheating on the metallographic structure of the black heart malleable cast iron were examined. Only 700 kg of a molten metal obtained by blending the raw materials to contain 3.0% by mass of carbon and 1.5% by mass of silicon, the balance being iron and inevitable impurities, was dispensed into a ladle. Then, 210 g (0.030% by mass) of bismuth was added to the molten metal, followed by stirring, and immediately poured into a mold for an elbow casting joint having a nominal diameter as shown in Table 5, thereby casting the molten metal as a casting material to produce a casting joint in each of Examples 7 to 10. The obtained cast metal contained 0.01% by mass of bismuth and 0.35% by mass of manganese derived from the raw material in addition to the above-mentioned amounts of carbon and silicon.

TABLE 5

| Sample | Nominal diameter (inch) | Preheating conditions Temperature (° C.) | Preheating conditions Time (min) | Distribution of lump graphite at crystal grain boundaries | Grain size (grain size number) |
|---|---|---|---|---|---|
| Example 7 | ¾ | 350 | 30 | YES | 8.0 |
| Example 8 | 1 | 400 | 30 | YES | 8.5 |
| Example 9 | 2 | 400 | 60 | YES | 8.5 |
| Example 10 | 3 | 400 | 180 | YES | 8.5 |

Then, after the cast metal was preheated at a temperature and for a period of time indicated in Table 5, it was further heated to 980° C. and then held for one hour, thereby performing the first stage graphitization. Subsequently, in each of Examples 7 to 9, the cast joint was cooled to 760° C. and then further cooled from 760° C. to 720° C. over one hour, thereby performing the second stage graphitization, whereby a sample of a black heart malleable cast iron was prepared. In Example 10, the cast metal was held at 980° C. for 1.5 hours in the first stage graphitization, and then cooled from 760° C. to 720° C. over 1.5 hours, thereby performing the second stage graphitization.

After a cut surface of a test specimen, taken from a barrel of the sample of the obtained casting joint, was polished, and the grain boundaries thereon were etched with nital, the metallographic structure of the cut surface was observed with an optical microscope. Table 5 respectively shows the evaluation result of the distribution state of the lump graphite in each sample and the result of measuring the grain size of the matrix of each sample in terms of grain size number by the same method as in First Example.

According to the above-mentioned Fourth Example, as shown in Examples 7 to 9, even when the preheating time at 350° C. or 400° C. is as short as 30 minutes or 60 minutes, the graphitization can be completed in a short time. Furthermore, it can be seen that Examples 7 to 9 can form the metallographic structure specific to the present invention in that the lump graphite is present while being dispersed at the positions of the crystal grain boundaries of the matrix, and the grain size of the matrix is 8.0 or more and 10.0 or less in terms of the grain size number numerically determined by comparison between the metallographic photograph thereof and the standard grain size chart. Furthermore, in a large-sized casting joint of Example 10, it can be seen that the preheating time at 400° C. is set to 180 minutes, and the first and second graphitizations are respectively performed over 1.5 hours, which can form the metallographic structure specific to the present invention in which the lump graphite is present while being dispersed at the positions of the crystal grain boundaries of the matrix, and the grain size of the matrix is 8.5 in the terms of grain size number.

Fifth Example

In Fifth Example, high-purity electrolytic iron was used as the raw material of iron for the purpose of eliminating the influence of the elements derived from the raw material. Here, 100 kg of a molten metal was prepared by blending the raw materials to contain 2.7% by mass of carbon, 1.2% by mass of silicon, and 0.30% by mass of manganese, the balance being iron. Only 50 kg of the obtained molten metal was dispensed into a ladle, and 15 g of bismuth was added to the molten metal, followed by stirring, and immediately poured into a casting mold, whereby the molten metal was cast to produce a cast metal of Example 11. The remaining 50 kg of the molten metal was dispensed into a ladle, and 30 g of bismuth was added thereto, followed by stirring, and immediately poured into a casting mold, whereby the molten metal was cast to produce a cast metal of Example 12. All the obtained cast metals contained the above amounts of carbon, silicon, and manganese. In addition, it is presumed that in each of the obtained cast metals, bismuth was contained within the range of amounts specified in the present invention.

Then, the cast metal was preheated at 400° C. over one hour and further heated such that its temperature was raised to 980° C. and then held for one hour, thereby performing the first stage graphitization. Subsequently, the cast metal was cooled to 760° C., and then further cooled from 760° C. to 720° C. over one hour, thereby performing the second stage graphitization. In this way, samples of the black heart malleable cast irons of Examples 11 and 12 were prepared.

Then, after the cut surface of the obtained sample was polished and the grain boundaries thereon were etched with nital, the metallographic structure of the cut surface was observed with an optical microscope. The lump graphite was present while being dispersed at positions of crystal grain boundaries of the matrix. Table 6 shows the measurement result of the grain size of the ferrite matrix determined by comparing between the metallographic photograph obtained by photographing the metallographic structure of the sample and the standard grain size chart of Non-Patent Document 1.

TABLE 6

| Sample | Amount of additive element (percentage by mass) C | Si | Mn | Bi | Distribution of lump graphite at crystal grain boundaries | Grain size (grain size number) |
|---|---|---|---|---|---|---|
| Example 11 | 2.7 | 1.2 | 0.30 | 0.03 | YES | 8.0 |
| Example 12 | 2.7 | 1.2 | 0.30 | 0.06 | YES | 8.0 |
| Comparative Example 7 | 2.7 | 1.2 | No addition | 0.03 | NO | 7.0 |

Comparative Example 7

In Comparative Example 7, a sample containing no manganese was prepared, unlike Examples 11 and 12 mentioned above. In detail, high-purity electrolytic iron was used as the raw material of iron. Here, 50 kg of a molten metal was prepared by blending the raw materials to contain 2.7% by mass of carbon and 1.2% by mass of silicon, the balance being iron. Then, the obtained molten metal was dispensed into a ladle, and then 15 g of bismuth was added to the molten metal, followed by stirring, and immediately poured into a casting mold, whereby the molten metal was cast to produce a cast metal of Comparative Example 7. The obtained cast metal contained the above contents of carbon and silicon, and the manganese content was below the range of contents specified by the present invention. Bismuth was supposed to be contained within the range of contents specified in the present invention. Then, the cast metal was preheated at 400° C. over one hour and further heated such that its temperature was raised to 980° C. and then held for 3 hours, thereby performing the first stage graphitization. Subsequently, the cast metal was cooled to 760° C., and then further cooled from 760° C. to 720° C. over 3 hours, thereby performing the second stage graphitization. In this way, a sample of a black heart malleable cast iron of Comparative Example 7 was prepared.

When observing the metallographic structure of the obtained sample, many particles of the lump graphite formed enormous lumps. Some particles of the lump graphite had a particle diameter exceeding the grain size of the matrix. Table 6 mentioned above shows the measurement result of the grain size of the ferrite matrix determined by comparing between the metallographic photograph obtained by photographing the metallographic structure of the sample and the standard grain size chart of Non-Patent Document 1.

According to Fifth Example mentioned above, as in Examples 11 and 12, the black heart malleable cast iron that is obtained by preheating before the graphitization while containing predetermined amounts of both bismuth and manganese has the metallographic structure specific to the black heart malleable cast iron according to the present invention. That is, the lump graphite is present while being dispersed at the positions of the grain boundaries of the matrix, and the grain size of the matrix is 8.0 or more and 10.0 or less in terms of grain size number, numerically determined by comparison between the metallographic photograph and the standard grain size chart. It can be seen that as in Comparative Example 7, when the cast iron contains only a specified amount of bismuth and the manganese content does not satisfy the range of contents specified by the present invention because the cast iron does not contain manganese derived from the raw material, a black heart malleable cast iron does not have the metallographic structure specific to the black heart malleable cast iron according to the present invention and needs a long-term graphitization time, compared to Examples.

Sixth Example

In Sixth Example, high-purity electrolytic iron was used as the raw material of iron for the purpose of eliminating the influence of the elements derived from the raw material. Here, 50 kg of a molten metal was prepared by blending the raw materials to contain 2.9% by mass of carbon, 1.3% by mass of silicon, 0.7% by mass of manganese, and 0.02% by mass of nitrogen, the balance being iron. Manganese nitride was used to add manganese mentioned above. The obtained molten metal was dispensed into a ladle, and 50 g of aluminum and 15 g of bismuth were respectively added to the molten metal, followed by stirring, and immediately poured into a casting mold, whereby the molten metal was cast to produce a cast metal of Example 13. The analyzed values of the alloy compositions of the cast metals are shown in Table 7. Then, after preheating the cast metal at 400° C. for 5 hours, the cast metal was heated such that its temperature was raised to 980° C. and held for one hour, thereby performing the first graphitization. Subsequently, after the cast metal was cooled until its temperature was at 760° C., the cast metal was then cooled from 760° C. to 720° C. over one hour, thereby performing the second graphitization. In this way, a sample of a black heart malleable cast iron in Example 13 was prepared.

After a cut surface of the obtained sample was polished and the grain boundaries thereon were etched with nital, the metallographic structure of the cut surface was observed with an optical microscope, which showed that the lump graphite was present while being distributed at positions of crystal grain boundaries of the matrix. The grain size of the ferrite matrix was measured by comparing the metallographic photograph obtained by photographing the metallographic structure of the sample with the standard grain size chart of Non-Patent Document 1. The average particle diameter and the number of particles of the lump graphite were measured by the same methods as in the First Example. Table 7 shows the obtained results. In Example 13, the metallographic structure specific to the black heart malleable cast iron according to the present invention could be formed in a short time so as to have refined lump graphite.

TABLE 7

| Sample | Alloy composition (percentage by mass) C | Si | S | Mn | Bi | Al | N | Distribution of lump graphite at crystal grain boundaries | Grain size (grain size number) | Average particle diameter of lump graphite (μm) | Number of particles of lump graphite (particles/mm$^2$) |
|---|---|---|---|---|---|---|---|---|---|---|---|
| Example 13 | 2.89 | 1.27 | 0.091 | 0.76 | 0.005 | 0.057 | 0.0220 | YES | 9.0 | 27 | 227 |
| Comparative Example 8 | | | | | | | | NO | 7.5 | 26 | 212 |
| Comparative Example 9 | 2.92 | 1.27 | 0.106 | 0.72 | 0.004 | 0.067 | 0.0030 | NO | 7.0 | 13 | 546 |
| Comparative Example 10 | | | | | | | | NO | 7.0 | 27 | 227 |

Comparative Example 8

The same cast metal as the cast metal obtained by casting in Example 13 was heated from room temperature to 980° C. without preheating and held for 8 hours, thereby performing the first stage graphitization. Subsequently, the cast metal was cooled to 760° C., and then cooled from 760° C. to 720° C. over 8 hours, thereby performing the second graphitization. In this way, a sample of a black heart malleable cast iron in Comparative Example 8 was prepared. Table 7 shows the evaluation results of the metallographic structure of the sample. In the sample of Comparative Example 8 that was not subjected to preheating, the graphitization was not completed even after the long-term graphitization process. As a result, a pearlite microstructure remained.

Comparative Example 9

A casting material was cast in the same way as in Example 13 and Comparative Example 8 except that ferromanganese was used to add manganese, instead of manganese nitride. Then, the resultant cast metal was subjected to heat treatment under the same conditions as in Example 13, thereby preparing a sample of Comparative Example 9. Table 7 shows evaluation results of the metallographic structures of the samples. In the sample of Comparative Example 9, although the graphitization was completed by the graphitization process in a short time, the sample had coarse grain size and did not have the metallographic structure specific to the black heart malleable cast iron according to the present invention.

Comparative Example 10

The same cast metal as the cast metal in Comparative Example 9 was heated from room temperature to 980° C. without preheating and held for 8 hours, thereby performing the first stage graphitization. Subsequently, after the cast metal was cooled to 760° C., the cast metal was cooled from 760° to 720° C. over 8 hours, thereby performing the second stage graphitization. In this way, a sample of a black heart malleable cast iron in Comparative Example 10 was prepared. Table 7 shows the evaluation results of the metallographic structure of this sample. In the sample of Comparative Example 10, the graphitization was not completed even after the long-term graphitization process. As a result, a pearlite microstructure remained.

According to Sixth Example mentioned above, when the black heart malleable cast iron simultaneously contains specified amounts of aluminum and nitrogen, it can be seen that the graphitization is completed by a short-time graphitization process, compared with the case where a cast iron contains aluminum and the nitrogen content therein is relatively small. Soluble nitrogen is generally known as an element that inhibits graphitization, but in the present invention, nitrogen acts as an element that promotes graphitization when coexisting with aluminum. It is presumed that the reason why the graphitization is promoted when a predetermined amount or more of nitrogen and aluminum coexist and the preheat is performed is that nitrogen binds to aluminum to form fine aluminum nitride within the temperature range of the preheating, and this aluminum nitride becomes a nucleus to promote the precipitation of graphite, as mentioned above.

This application claims priority based on Japanese Patent Application No. 2017-061680, the disclosure of which is incorporated by reference herein.

The invention claimed is:

1. A black heart malleable cast iron comprising a matrix of ferrite and lump graphite included in the matrix, the black heart malleable cast iron comprising:

0.0050% by mass or more and 0.15% by mass or less of bismuth and 0.020% by mass or more and 0.50% by mass or less of manganese, wherein the black heart malleable cast iron excludes aluminum;

wherein a grain size of the matrix is 8.0 or more and 10.0 or less in terms of grain size number, numerically determined by comparison between a metallographic photograph of the matrix and a standard grain size chart.

2. The black heart malleable cast iron according to claim 1, wherein the lump graphite is present while being dispersed at positions of crystal grain boundaries of the matrix.

3. The black heart malleable cast iron according to claim 1, wherein an average particle diameter of particles of the lump graphite is 10 micrometers or more and 40 micrometers or less.

4. The black heart malleable cast iron according to claim 1, wherein the number of particles of the lump graphite per square millimeter of a cross-sectional area thereof is 200 or more and 1,200 or less.

5. The black heart malleable cast iron according to claim 1, further comprising 2.0% by mass or more and 3.4% by mass or less of carbon, and 0.5% by mass or more and 2.0% by mass or less of silicon, the balance being iron and inevitable impurities.

6. The black heart malleable cast iron according to claim 5, wherein the carbon content is 2.5% by mass or more and 3.2% by mass or less, and silicon content is 1.0% by mass or more and 1.7% by mass or less.

7. The black heart malleable cast iron according to claim 5, further comprising more than 0% by mass and 0.010% by mass or less of boron.

8. The black heart malleable cast iron according to claim 2, wherein an average particle diameter of particles of the lump graphite is 10 micrometers or more and 40 micrometers or less.

9. The black heart malleable cast iron according to claim 2, wherein the number of particles of the lump graphite per square millimeter of a cross-sectional area thereof is 200 or more and 1,200 or less.

10. The black heart malleable cast iron according to claim 3, wherein the number of particles of the lump graphite per square millimeter of a cross-sectional area thereof is 200 or more and 1,200 or less.

11. The black heart malleable cast iron according to claim 8, wherein the number of particles of the lump graphite per square millimeter of a cross-sectional area thereof is 200 or more and 1,200 or less.

* * * * *